US007959046B2

(12) United States Patent
Burnsed, Jr. et al.

(10) Patent No.: US 7,959,046 B2
(45) Date of Patent: Jun. 14, 2011

(54) METHODS, SYSTEMS, AND APPARATUS FOR PROVIDING A MULTIPLE POSITION SLING FOR A FIREARM

(75) Inventors: Ashley A. Burnsed, Jr., Port Wentworth, GA (US); Marvin C. Daniel, Savannah, GA (US)

(73) Assignee: Blue Force Gear, Inc., Pt. Wentworth, GA (US)

( * ) Notice: Subject to any disclaimer, the term of this patent is extended or adjusted under 35 U.S.C. 154(b) by 1450 days.

(21) Appl. No.: 11/153,717

(22) Filed: Jun. 14, 2005

(65) Prior Publication Data

US 2006/0011677 A1 Jan. 19, 2006

Related U.S. Application Data

(60) Provisional application No. 60/579,858, filed on Jun. 14, 2004.

(51) Int. Cl.
*F41C 23/02* (2006.01)

(52) U.S. Cl. ..... 224/150; 224/578; 224/913

(58) Field of Classification Search ..... 224/150, 224/149, 257, 258, 264, 578, 579, 913, 600, 224/250; 24/2.5, 302; 42/85, 94
See application file for complete search history.

(56) References Cited

U.S. PATENT DOCUMENTS

| | | | | |
|---|---|---|---|---|
| 2,812,123 | A | 11/1957 | Girton | |
| 4,511,070 | A | 4/1985 | Hightower | |
| 5,082,155 | A * | 1/1992 | Salvador | 224/150 |
| 5,246,154 | A * | 9/1993 | Adams et al. | 224/257 |
| 5,282,558 | A * | 2/1994 | Martinez | 224/150 |
| 5,810,219 | A * | 9/1998 | Rosenfield | 224/150 |
| 6,068,167 | A * | 5/2000 | Hopson | 224/150 |
| 6,520,390 | B2 * | 2/2003 | Verdugo et al. | 224/150 |
| 6,932,254 | B2 * | 8/2005 | Eliason | 224/150 |
| 7,059,502 | B2 | 6/2006 | Johnson | |
| 7,069,624 | B2 | 7/2006 | Johnson | |
| 2002/0020724 | A1 * | 2/2002 | Lindsey | 224/150 |
| 2004/0188476 | A1 | 9/2004 | Johnson | |
| 2008/0217371 | A1 | 9/2008 | Wemmer | |

OTHER PUBLICATIONS

The 2P: A Combat Tactical Sling System for the 21st Century <http://redi-mag.com/2psling.php>.

* cited by examiner

*Primary Examiner* — Nathan J Newhouse
*Assistant Examiner* — Corey N Skurdal
(74) *Attorney, Agent, or Firm* — Sutherland Asbill & Brennan LLP

(57) ABSTRACT

Methods, systems, and apparatus for supporting a firearm from a user. An apparatus according to one embodiment of the invention includes a sling capable of supporting a firearm from a portion of a user's body. The sling can include a strap capable of being supported by a portion of a user's body. The sling can also include a first connector mounted to a first portion of the strap, the first connector capable of mounting to a firearm connector. Furthermore, the sling can include a second connector mounted to a second portion of the strap, the second connector capable of mounting to a third connector, and further capable of mounting to a second firearm connector. Moreover, the sling can include a third connector mounted to a third portion of the strap, the third connector capable of mounting to the second connector, whereby the mounting of the second connector to the third connector creates a loop in the strap. In one aspect of the invention, the sling can include a fourth connector mounted to a fourth portion of the strap, wherein the fourth connector is capable of mounting to the second firearm connector.

26 Claims, 10 Drawing Sheets

METHODS, SYSTEMS, AND APPARATUS FOR PROVIDING A MULTIPLE POSITION SLING FOR A FIREARM

RELATED APPLICATION

This application relates to and claims the benefit on U.S. Provisional Application No. 60/579,858, entitled "Methods and Systems for Providing a Multiple Position Sling for a Firearm," filed Jun. 14, 2004, the entire contents of which are hereby expressly incorporated by this reference.

FIELD OF THE INVENTION

The invention relates generally to the field of firearms, and more particularly, relates to improved methods, systems, and apparatus for providing a multiple position sling for a firearm.

BACKGROUND OF THE INVENTION

Conventional systems and methods for supporting a firearm from a person are sometimes complicated. In some instances, there are complicated routines to learn for using a conventional sling. Other types of slings are not easy to put on a user's body, and are sometimes difficult to take off the user's body. Some firearm slings can become uncomfortable to wear when a firearm is supported by such a sling. Other types of slings can interfere with the user's movement and could increase a user's response time in a combat or hunting situation. Yet other types of slings are only adapted for a supporting a firearm in a single position. If additional positions are needed or desired by a user, the user may need to acquire additional components to adapt the sling or, in some instances, may need to replace the sling with a sling adapted for the additional position needed or desired. Adaptation or replacement of a conventional sling can be cumbersome and time consuming.

Therefore, a need exists for improved methods, systems, and apparatus for providing a sling for a firearm.

Another need exists for methods, systems, and apparatus for providing a multiple position sling for a firearm.

A further need exists for a multiple position sling for supporting a firearm from a person.

Yet a further need exists for a multiple position sling for supporting a firearm such as a rifle from a person.

SUMMARY OF THE INVENTION

The present invention provides some or all of the needs described above. In one embodiment of the present invention, a multiple position sling for supporting a firearm from a person can be provided. In this embodiment, the sling is capable of being deployed in a multiple positions with respect to the firearm, and provide a user or person with the flexibility to deploy the firearm in any of the multiple positions needed or desired.

An apparatus according to one embodiment of the invention includes a sling capable of supporting a firearm from a portion of a user's body. The sling can include a strap capable of being supported by a portion of a user's body. The sling can also include a first connector mounted to a first portion of the strap, the first connector capable of mounting to a firearm connector. Furthermore, the sling can include a second connector mounted to a second portion of the strap, the second connector capable of mounting to a third connector, and further capable of mounting to a second firearm connector. Moreover, the sling can include a third connector mounted to a third portion of the strap, the third connector capable of mounting to the second connector, whereby the mounting of the second connector to the third connector creates a loop in the strap. In one aspect of the invention, the sling can include a fourth connector mounted to a fourth portion of the strap, wherein the fourth connector is capable of mounting to the second firearm connector.

In one aspect of the invention, a fourth connector can mount to a fourth portion of the strap, wherein the fourth connector is capable of mounting to the second firearm connector.

In yet another aspect of the invention, sling can also include an adjustment device capable of sizing the loop.

In yet another aspect of the invention, the sling can also include a covering device capable of being positioned along the strap, and further capable of limiting movement of at least one of the following: first connector, second connector, or third connector.

In yet another aspect of the invention, the sling and adjustment device are capable of sizing the loop.

In yet another aspect of the invention, the sling can also include a covering device capable of being positioned along the strap, and further capable of limiting movement of at least one of the following: first connector, second connector, third connector, or fourth connector.

In yet another aspect of the invention, the firearm can include at least one of the following: an automatic weapon, a semi-automatic weapon, a manually fired weapon, a M4, a M16A1, or a M16A2.

In yet another aspect of the invention, the strap can include at least one of the following: a low infrared reflectance material.

In yet another aspect of the invention, the connectors can include at least one of the following: a FASTEX™ side release buckle connector with a male-end, a side release buckle, a cam buckle, a snap hook, or a push button quick disconnect (QD)-type device, a quick-release snap shackle, or a swivel stud connection.

In yet another aspect of the invention, the adjustment device can include at least one of the following: a triglide, a ladderloc, or cam buckle.

In yet another aspect of the invention, the covering device can include at least one of the following: a band, or an elastic band.

In yet another aspect of the invention, a portion of the firearm can include at least one of the following: receiver, front portion of a firearm, a handguard, rear portion of a firearm, buttstock, or a barrel.

Another embodiment in accordance with the invention can include a system for supporting a firearm from a user. The system can include at least one firearm connector capable of mounting to a portion of a firearm, and a sling capable of supporting a firearm from a portion of a user's body. The sling can include a strap capable of being supported by a portion of a user's body. The strap can also include a first connector mounted to a first portion of the strap, the first connector capable of mounting to the first firearm connector. Furthermore, the strap can include a second connector mounted to a second portion of the strap, the second connector capable of mounting to a third connector, and further capable of mounting to a second firearm connector. Moreover, the strap can include a third connector mounted to a third portion of the strap, the third connector capable of mounting to the second connector, whereby the mounting of the second connector to the third connector creates a loop in the strap.

In another aspect of the invention, the sling can include a fourth connector mounted to a fourth portion of the strap, wherein the fourth connector is capable of mounting to the second firearm connector.

In yet another aspect of the invention, the sling can include an adjustment device capable of sizing the loop.

In yet another aspect of the invention, the sling can include a covering device capable of being positioned along the strap, and further capable of limiting movement of at least one of the following: first connector, second connector, or third connector.

In yet another aspect of the invention, the sling can include a covering device capable of being positioned along the strap, and further capable of limiting movement of at least one of the following: first connector, second connector, third connector, or fourth connector.

In yet another aspect of the invention, the firearm can include at least one of the following: an automatic weapon, a semi-automatic weapon, a manually fired weapon, a M4, a M16A1, or a M16A2.

In yet another aspect of the invention, the strap can include at least one of the following: a non-infrared material, or a near-infrared material.

In yet another aspect of the invention, the connectors can include at least one of the following: a FASTEX™ side release buckle connector with a male-end, a side release buckle with a female-end, a side release buckle, a cam buckle, a snap hook, or a push button quick disconnect (QD)-type device, a quick-release snap shackle, or a swivel stud connection.

In yet another aspect of the invention, the adjustment device can include at least one of the following: a triglide, or a ladderloc, or a cam buckle.

In yet another aspect of the invention, the covering device can include at least one of the following: a band, or an elastic band.

In yet another aspect of the invention, a portion of the firearm can include at least one of the following: receiver, front portion of a firearm, a handguard, rear portion of a firearm, buttstock, or a barrel.

Another embodiment in accordance with the invention can include a method for supporting a firearm from a person, such as in a one-point mode. The method can include providing a firearm connector, wherein the firearm connector can be mounted to a portion of the firearm. The method can also include providing a sling capable of supporting a firearm from a portion of a person's body. The sling can include a strap capable of being supported by a portion of a person's body. Furthermore, the sling can include a first connector mounted to a first portion of the strap, the first connector capable of mounting to a firearm connector. Moreover, the sling can include a second connector mounted to a second portion of the strap, the second connector capable of mounting to a third connector, and further capable of mounting to a second firearm connector. Further, the sling can include a third connector mounted to a third portion of the strap, the third connector capable of mounting to the second connector. The method can also include mounting the second connector to the third connector, whereby a loop in the strap is formed. Moreover, the method can include positioning the loop over a portion of a person's body, wherein the strap can be supported by the portion of the person's body. Further, the method can include mounting the first connector to the firearm connector, wherein the firearm is supported from the portion of the person's body by the sling.

Another embodiment in accordance with the invention can include another method for supporting a firearm from a person, such as in a two-point mode. The method can include providing a firearm connector, wherein the firearm connector can be mounted to a portion of a firearm. Furthermore, the method can include providing a second firearm connector, wherein the second firearm connector can be mounted to a second portion of the firearm. In addition, the method can include providing a sling capable of supporting a firearm from a portion of a person's body. The sling can include a strap capable of being supported by a portion of a person's body. Furthermore, the sling can include a first connector mounted to a first portion of the strap, the first connector capable of mounting to a firearm connector. In addition, the sling can include a second connector mounted to a second portion of the strap, the second connector capable of mounting to a third connector, and further capable of mounting to a second firearm connector. Moreover, the sling can include a third connector mounted to a third portion of the strap, the third connector capable of mounting to the second connector. The method can also include mounting the first connector to the firearm connector. Furthermore, the method can include mounting the second connector to the second firearm connector, whereby the strap and firearm can be supported by the portion of the person's body. In addition, the method can include positioning the loop over a portion of a person's body, wherein the strap and firearm are supported by the portion of the person's body.

Another embodiment in accordance with the invention can include yet another method for supporting a firearm from a person, such as in a three point mode. The method can include providing a firearm connector, wherein the firearm connector can be mounted to a portion of the firearm. Furthermore, the method can include providing a sling capable of supporting a firearm from a portion of a person's body. The sling can include a strap capable of being supported by a portion of a person's body. Furthermore, the sling can include a first connector mounted to a first portion of the strap, the first connector capable of mounting to a firearm connector. In addition, the sling can include a second connector mounted to a second portion of the strap, the second connector capable of mounting to a third connector, and further capable of mounting to a second firearm connector. Moreover, the sling can include a third connector mounted to a third portion of the strap, the third connector capable of mounting to the second connector. Further, the sling can include a fourth connector mounted to a fourth portion of the strap, wherein the fourth connector is capable of mounting to the second firearm connector. The method can also include mounting the second connector to the third connector, whereby a loop in the strap is formed. Furthermore, the method can include positioning the loop over a portion of a person's body, wherein the strap can be supported by the portion of the person's body. In addition, the method can include mounting the first connector to the firearm connector, and further mounting the fourth connector to the second firearm connection, wherein the firearm is supported from the portion of the person's body by the sling.

Objects, features and advantages of various systems, methods, and apparatuses according to various embodiments of the invention can include:

(1) providing improved methods, systems, and apparatus for providing a sling for a firearm;

(2) providing methods, systems, and apparatus for providing a multiple position sling for a firearm;

(3) providing a multiple position sling for supporting a firearm from a person;

(4) providing a multiple position sling for supporting a firearm such as a rifle from a person; and (5) providing a kit for supporting a firearm from a person.

Other objects, features and advantages of various aspects and embodiments of systems, methods, and apparatuses according to the invention are apparent from the other parts of this document.

DETAILED DESCRIPTION

The present invention comprises methods, systems, and apparatus for providing a multiple position sling for a firearm. One example of a multiple position sling in accordance with an embodiment of the invention is manufactured and distributed by Blue Force Gear, Inc. of Savannah, Ga. under the trademark SOC-C Sling™, also known as the "Special Operations Capable—Convertible" Sling™. Methods, systems, and apparatus in accordance with an embodiment of the invention can provide a multi-position sling for a user to configure to various multiple firearm slinging configurations. A sling in this and other embodiments can provide standardization of a user's military unit standard operating procedure (SOP) and can minimize and simplify logistics for the user's military unit. Using a sling in accordance with embodiments of the invention can reduce the number of components needed over conventional slings when multiple sling configurations are desired from a single sling.

Figure 1:
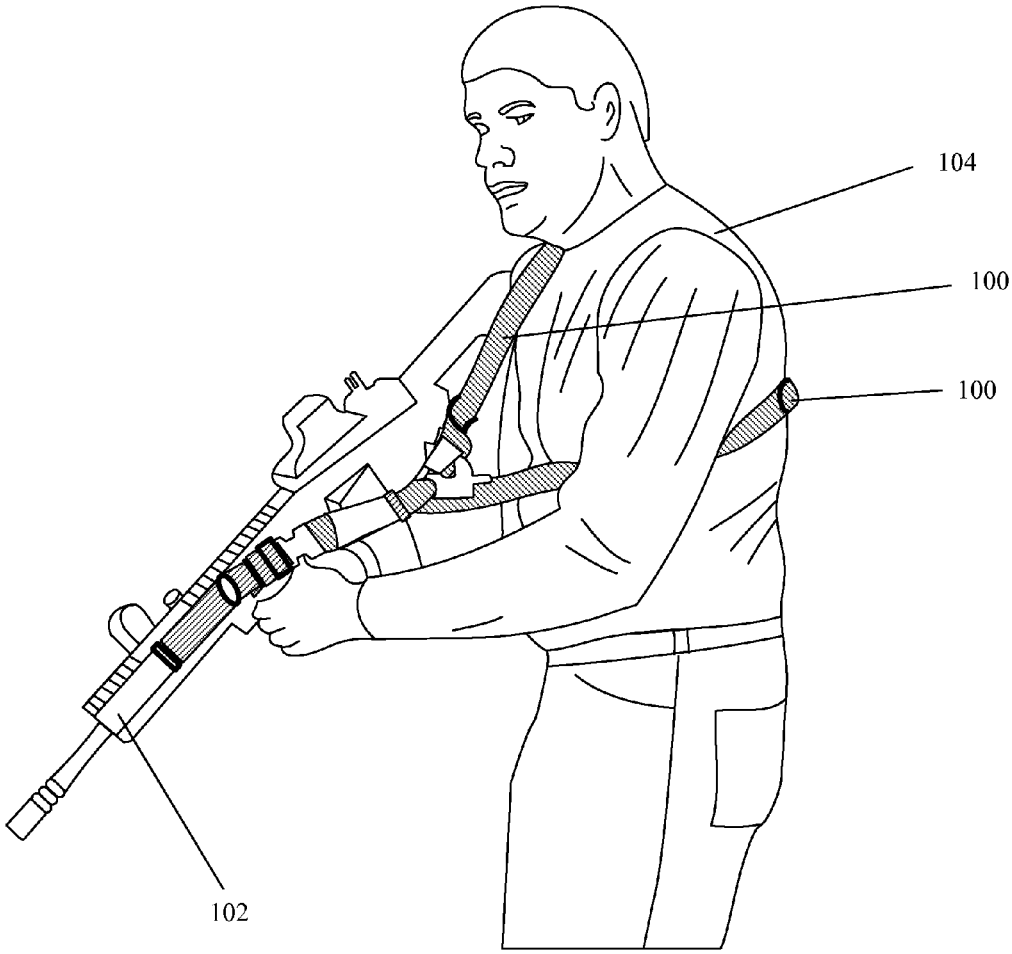
FIG. 1 is a perspective view of a multi-position sling in a one-point mode in accordance with an embodiment of the invention, with the sling shown supporting a firearm from a person.

FIG. 1 is a perspective view of an environment for an embodiment of the invention. The embodiment shown in FIG. 1 is a multi-position sling 100 in a one-point mode for supporting a firearm 102 from a user or person 104. The user or person 104 shown is illustrated supporting the firearm 102 using the sling 100.

Figure 2:
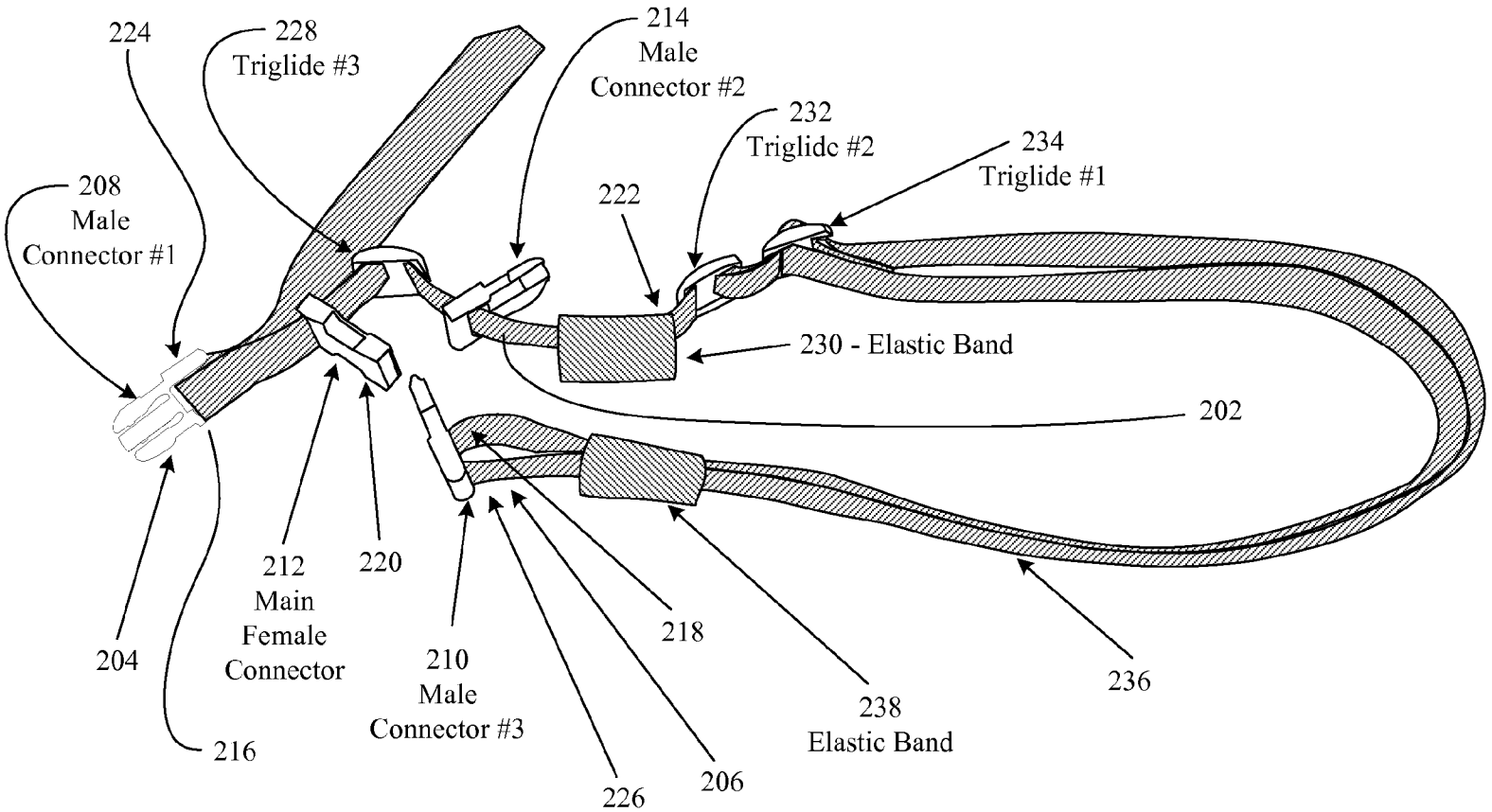
FIGS. 2-3 illustrate other perspective views of the sling shown in FIG. 1, with the sling in a one or single point mode, with the sling shown supporting a firearm from a person.
Figure 3:
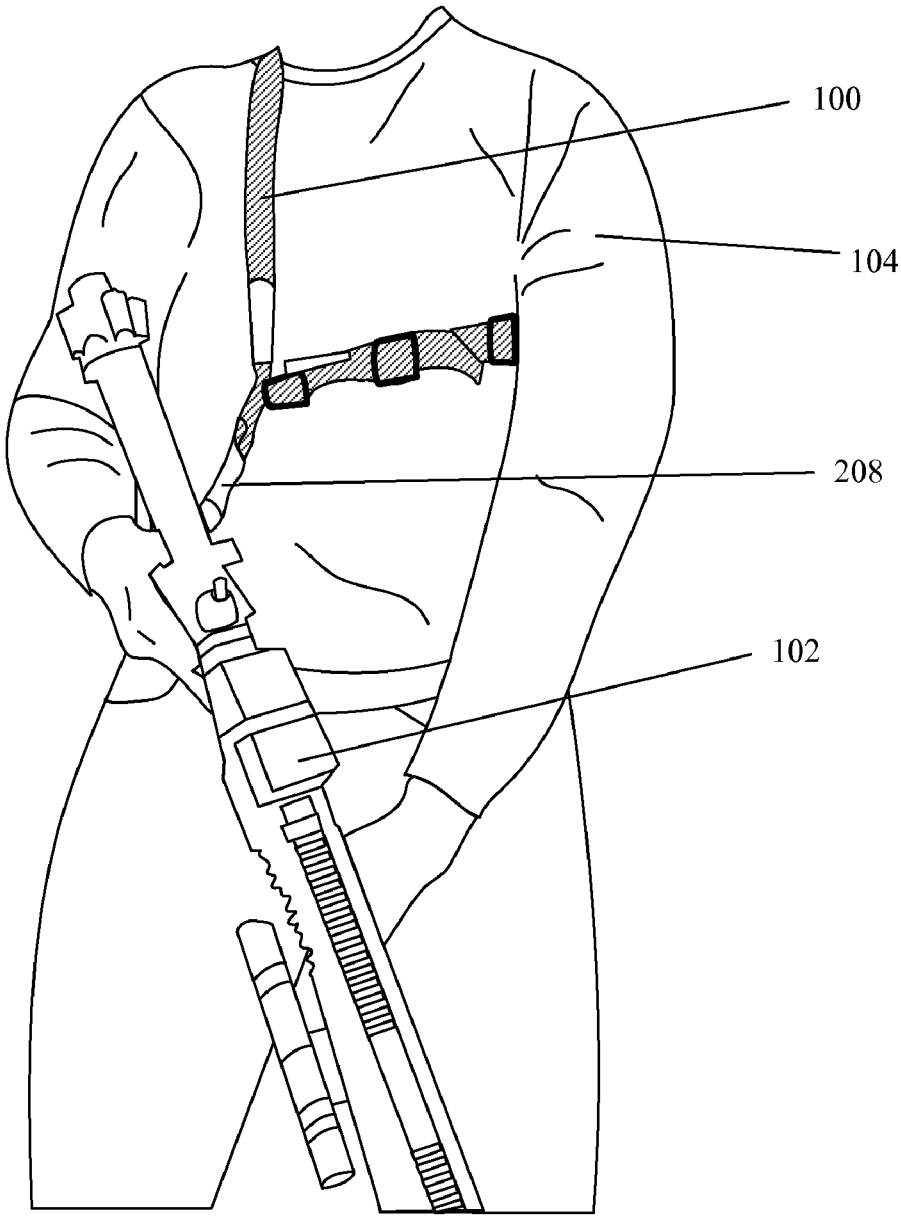

FIGS. 2-3 illustrate perspective views of the embodiment of the sling 100 shown in FIG. 1. FIG. 2 shows a sling 200 in a released position, unconnected to any firearm and not being worn by any user or person. The sling 200 shown can include a strap 202 with an end 204 and an opposing end 206. The strap 202 can be shaped as an elongated length of material, and can be "doubled over" or overlapped at either or both ends 204, 206 as needed. One suitable material for a strap 202 can be Solution Dye CORDURA® webbing in color U.S. Marine Corps Coyote 498 with low Near Infrared reflectance (NIR). A strap can be manufactured from one or more materials such as, but not limited to, air jet textured yarns, non textured "flat" filament based fabrics, or other suitable fabrics or materials.

A sling in accordance with an embodiment of the invention can include one or more connectors 208, 210, 212, 214. Each connector 208, 210, 212, 214 is capable of mounting to a corresponding connector, wherein the corresponding connector is either mounted to a portion of a firearm to be supported, or along a portion of the sling 200. The sling 200 shown in FIG. 2 includes a first connector 208, a second connector 210, a third connector 212, and a fourth connector 214. Other embodiments in accordance with the invention can include fewer or greater numbers of connectors. Each connector 208, 210, 212, 214 can be mounted to a respective portion of the strap 202, such as a respective first portion 216, second portion 218, third portion 220, fourth portion 222, etc. Furthermore, each connector 208, 210, 212, 214 may be capable of mounting to a respective portion of a firearm with or without a corresponding mount, connector, or other suitable device.

For example, as shown and described in FIG. 2, the first connector 208 can mount to a first portion 216 of the strap 202. In the embodiment shown, the first connector 208 mounts adjacent to one end 204 of the strap 202. The first connector 208 shown is adapted to mount to a corresponding connector, such as a female-end of a firearm connector, which has been previously mounted to a firearm. A "firearm connector" is defined herein as any type of connector or mounting capable of corresponding to or connecting with a connector associated with a sling in accordance with an embodiment of the invention. A firearm connector can be connected to, mounted to, or otherwise integrated with a portion of a firearm including, but not limited to, receiver, front portion of a firearm, a handguard, rear portion of a firearm, buttstock, or a barrel of a firearm.

In the embodiment shown, the strap 202 can be looped through a portion of the first connector 208, wherein a portion of the strap becomes overlapped 224 upon itself. The position of the first connector 208 with respect to the strap 202 can be maintained by clasping the overlapped portion 224 of the strap 202, or by sewing or stitching at least some of the overlapped portion 224 of the strap 202. A suitable component for a first connector 208 can be a FASTEX™ side release buckle connector with a male-end. A first connector can include, but is not limited to, a side release buckle with a female-end, a side release buckle, a cam buckle, a snap hook, a push button quick disconnect (QD)-type device, an eyelet, a quick-release snap shackle, or a swivel stud connection.

The second connector 210 shown in FIG. 2 mounts to a second portion 218 of the strap 202. In the embodiment shown, the second connector 210 mounts adjacent to an opposing end 206 of the strap 202. The second connector 210 shown is adapted to mount to a corresponding connector, such as a female-end of the third connector 212, mounted near the other end 204 of the strap 202. In the embodiment shown, the strap 202 can be looped through a portion of the second connector 210, wherein a portion of the strap becomes overlapped 226. The position of the second connector 210 with respect to the strap 202 can be maintained by clasping the overlapped portion 226 of the strap 202, or adjusting a covering device 238 around the overlapped portion 226 of the strap 202. A suitable component for a second connector 210 can be a FASTEX™ side release buckle connector with a male-end. A second connector can include, but is not limited to, a side release buckle with a female-end, a side release buckle, a cam buckle, a snap hook, a push button quick disconnect (QD)-type device, an eyelet, a quick-release snap shackle, or a swivel stud connection.

The third connector 212 shown in FIG. 2 mounts to a third portion 220 of the strap 202. In the embodiment shown, the third connector 212 mounts adjacent to the end 204 of the strap 202. The third connector 212 shown is adapted to mount to a corresponding connector, such as a male-end of the second connector 210, mounted near the opposing end 206 of the strap 202. In the embodiment shown, the strap 202 can be looped through a portion of the third connector 212, wherein the position of the third connector 212 with respect to the strap 202 can be maintained between a clasped, stitched or sewed overlapped portion 224 of the strap 202 and an adjustment device, such as 228, mounted to the overlapped portion 226 of the strap 202. A suitable component for a third connector 212 can be a FASTEX™ side release buckle connector with a female-end. A third connector can include, but is not limited to, a side release buckle with a female-end, a side release buckle, a cam buckle, a snap hook, a push button quick disconnect (QD)-type device, an eyelet, a quick-release snap shackle, or a swivel stud connection.

The fourth connector 214 shown in FIG. 2 mounts to a fourth portion 222 of the strap 202. In the embodiment shown, the fourth connector 214 mounts adjacent to an intermediate portion of the strap 202, near the end 204 of the strap 202. In the embodiment shown, the strap 202 can be looped through a portion of the fourth connector 214, wherein the position of the fourth connector 214 with respect to the strap 202 can be maintained between an adjustment device, such as 228, mounted to the overlapped portion 224 of the strap 202 and a covering device 230, another adjustment device 232, or a clasped, stitched, or sewn portion of the overlapped portion 224 of the strap 202. A suitable component for a fourth connector 214 can be a FASTEX™ side release buckle connector with a male-end. A fourth connector can include, but is not limited to, a side release buckle with a female-end, a side release buckle, a cam buckle, a snap hook, a push button quick disconnect (QD)-type device, an eyelet, a quick-release snap shackle, or a swivel stud connection.

A sling in accordance with an embodiment of the invention can also include one or more adjustment devices 228, 232, 234. Each adjustment device 228, 232, 234 is capable of being adjusted to a particular position along the length of the strap 202, and is further capable of maintaining its position with respect to the strap 202 when the strap 202 is in use. The sling 200 shown in FIG. 2 includes a first adjustment device 228, a second adjustment device 232, and a third adjustment device 234. Other embodiments in accordance with the invention can include fewer or greater numbers of adjustment devices. Each adjustment device 228, 232, 234 can be mounted to a respective portion of the strap 202, such as a respective overlapped portion 236 or almost anywhere along the length of the strap, etc. Furthermore, each adjustment device 228, 232, 234 may be capable of mounting to a respective portion of a firearm with or without a corresponding mount, connector, or other suitable device.

For example, a first adjustment device 228 shown in FIG. 2 can be mounted to portion of the strap 202. The strap 202 can be looped through a portion of the first adjustment device 228, and then may looped again through the same or different portion of the first adjustment device 228. As shown in FIG. 2, the first adjustment device 228 can be positioned along a portion of the strap 202 between the third connector 212 and fourth connector 214. A suitable first adjustment device 228 is a FASTEX™ tri-glide or double hole piece. A first adjustment device can include, but is not limited to, a tri-glide, a ladderloc, and a cam buckle.

A second adjustment device 232 shown in FIG. 2 can be mounted to another portion of the strap 202. The strap 202 can be looped through a first and second hole or portion of the second adjustment device 232. As shown in FIG. 2, the second adjustment device 232 can be positioned along a portion of the strap 202 between the second connector 210 and the fourth connector 214, and relatively closer to the fourth connector 214. A suitable second adjustment device 232 is a FASTEX™ tri-glide or double hole piece. A second adjustment device can include, but is not limited to, a tri-glide, a ladderloc, and a cam buckle.

A third adjustment device 234 shown in FIG. 2 can be mounted to another portion of the strap 202. The strap 202 can be looped through a first and second hole or portion of the third adjustment device 234. As shown in FIG. 2, the third adjustment device 234 can be positioned along an overlapped portion 236 of the strap 202 between the second connector 210 and the fourth connector 214. A suitable third adjustment device 234 is a FASTEX™ tri-glide or double hole piece. A third adjustment device can include, but is not limited to, a tri-glide, a ladderloc, and a cam buckle.

The sling 200 can also include one or more covering devices 230, 238. The covering devices 230, 238 are adapted to cover a portion of the strap 202. In FIG. 2, the covering devices 230, 238 are flexible elastic, cylindrically-hollow, band shaped pieces which encompass the circumference of a respective portion of the strap 202. As shown in this embodiment, a first covering device 238 is positioned adjacent to the second connector 210. The first covering device 238 can be positioned with respect to the strap 202 to maintain the relative position of the second connector 210 with respect to the strap 202. Furthermore, the second covering device 230, as shown in FIG. 2, can be positioned between the second adjustment device 232 and the third adjustment device 234. In one embodiment, the second covering device 230 can be positioned between the fourth connector 214 and the second adjustment device 232 along a portion of the strap 202. The second covering device 230 can be positioned with respect to the strap 202 to maintain the relative position of the fourth connector 214 with respect to the strap 202.

Other embodiments of a sling in accordance with the invention can have various attachment points including, but not limited to, silent cord, side release buckle adapters, standard quick disconnect (QD), push button quick disconnect (QD), snap hook fasteners, webbing loops, or combinations of some or all of the above. Furthermore, embodiments of a sling in accordance with the invention have various weapon attachment points including, but not limited to, sling adapters for various suitable firearm systems.

Embodiments of a sling in accordance with the invention can include suitable materials and components with some or all of the following characteristics: relatively high "lot to lot" color uniformity, relatively low shine luster which reduces detectability in daytime conditions, relatively high resistance to fading, relatively low infrared (IR) signature, such as in accordance with a near infrared reflectance (NIR) reflectance specification. Furthermore, some or all of the components for a sling in accordance with some embodiments of the invention can be integrated or partially integrated with various components of the sling. Moreover, other embodiments of a sling in accordance with the invention can have similar or coordinated colors used in conjunction with embodiments of the sling can have a standard color such as Coyote Brown, or other colors or shades. Such suitable colors can include built in color durability depending on the materials used for the embodiments of the sling.

The sling 100, 200 shown in FIGS. 2 and 3 can be worn by a user in at least a first, second, third mode, or fourth mode. In other embodiments of the invention, fewer or greater numbers of modes can exist. In a first mode, or single point mode, a user can mount the second connector 210 and third connector 212 to form a loop in the strap 202. The first connector 208 can be mounted with a firearm connector which can be mounted to an associated firearm, such as a butt or receiver end of a rifle with a FASTEX™ buckle connector having a corresponding female-end. Either or both of the first adjustment device 228 and third adjustment device 234 can be positioned relative to respective positions along the strap 202 to increase or decrease the size of the loop. When the third adjustment device 234 is repositioned with respect to the strap 202, relatively greater changes in the size of the loop can be achieved. The loop can then be positioned over a portion of a user's body, such as across his or her shoulder or upper torso. The first covering device 238 and second covering device 230 can be adjusted as needed to maintain the positions of respective connectors 210, 222 or to cover particular portions of the strap 202. In this manner, the sling 100, 200 can support a firearm 102 from a user or person.

The embodiment shown in FIGS. 1 and 3 is deployed in a first mode or "single point" mode. As shown in FIG. 3, the firearm 102 is supported from a user or person 104 via the first connector 208, or a single point, by the sling 100. This particular mode is considered by some users to be the best for fast paced urban operations where speed and simplicity dominate. For example, any firearm controls and rail-mounted accessories associated with the firearm 102 are relatively unencumbered by the sling 100.

Figure 4:
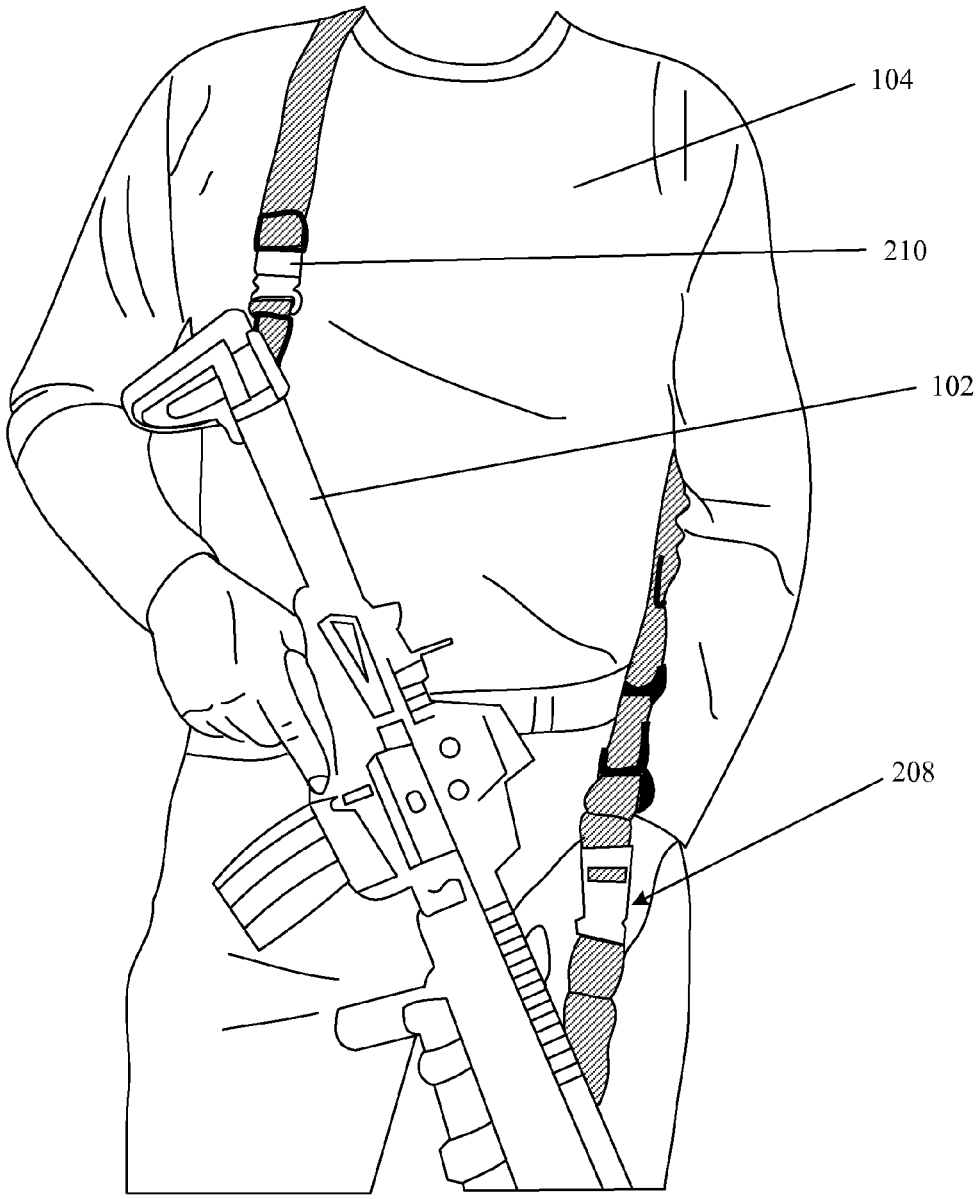
FIG. 4 is a perspective view of a multi-position sling in a two-point mode in accordance with an embodiment of the invention, with the sling shown supporting a firearm from a person.

FIG. 4 is a perspective view of a multi-position sling 100 in a two-point mode for supporting a firearm 102 from a user or person 104. The embodiment shown in FIG. 4 is the same sling 100 shown in FIGS. 1 and 3 deployed in a second mode or "two point" mode. As shown in FIG. 4, the firearm 102 is supported from a user or person 104 via the first connector 208 and the second connector 210, or at two points, by the sling 100. In this particular mode, some precision riflemen may prefer this configuration for the support the sling 100 can provide while the rifleman is aiming and/or discharging the firearm. This particular mode may be considered one mode for patrolling and non-combat carrying of the firearm, but may be a difficult position to handle the firearm in fluid situations where a user may need the use of his or her hands, such as cuffing a suspect or transitioning to a secondary weapon.

Referring to FIG. 2, to configure and wear a sling in accordance with an embodiment of the invention for this particular mode, the first connector 208 can be mounted to a firearm connector, such as a FASTEX™ side release buckle connector having a corresponding female-end, associated with a front sling point of the firearm. Furthermore, the second connector 210 can be mounted to a firearm connector, such as a FASTEX™ side release buckle connector having a corresponding female-end, associated with a rear sling point of the firearm. Either or both of the first adjustment device 228 and third adjustment device 232 can be positioned relative to respective positions along the strap 202 to increase or decrease the length of the strap 202. When the third adjustment device 232 is repositioned with respect to the strap 202, relatively greater changes in length of the strap 202 can be achieved. The strap 202 can then be positioned over a portion of a user's body, such as across his or her shoulder or upper torso. The first covering device 238 and second covering device 230 can be adjusted as needed to maintain the positions of respective connectors 210, 214 or to cover particular portions of the strap 202. In this manner, the sling 200 can support a firearm such as 102 from a user or person.

Figure 5:
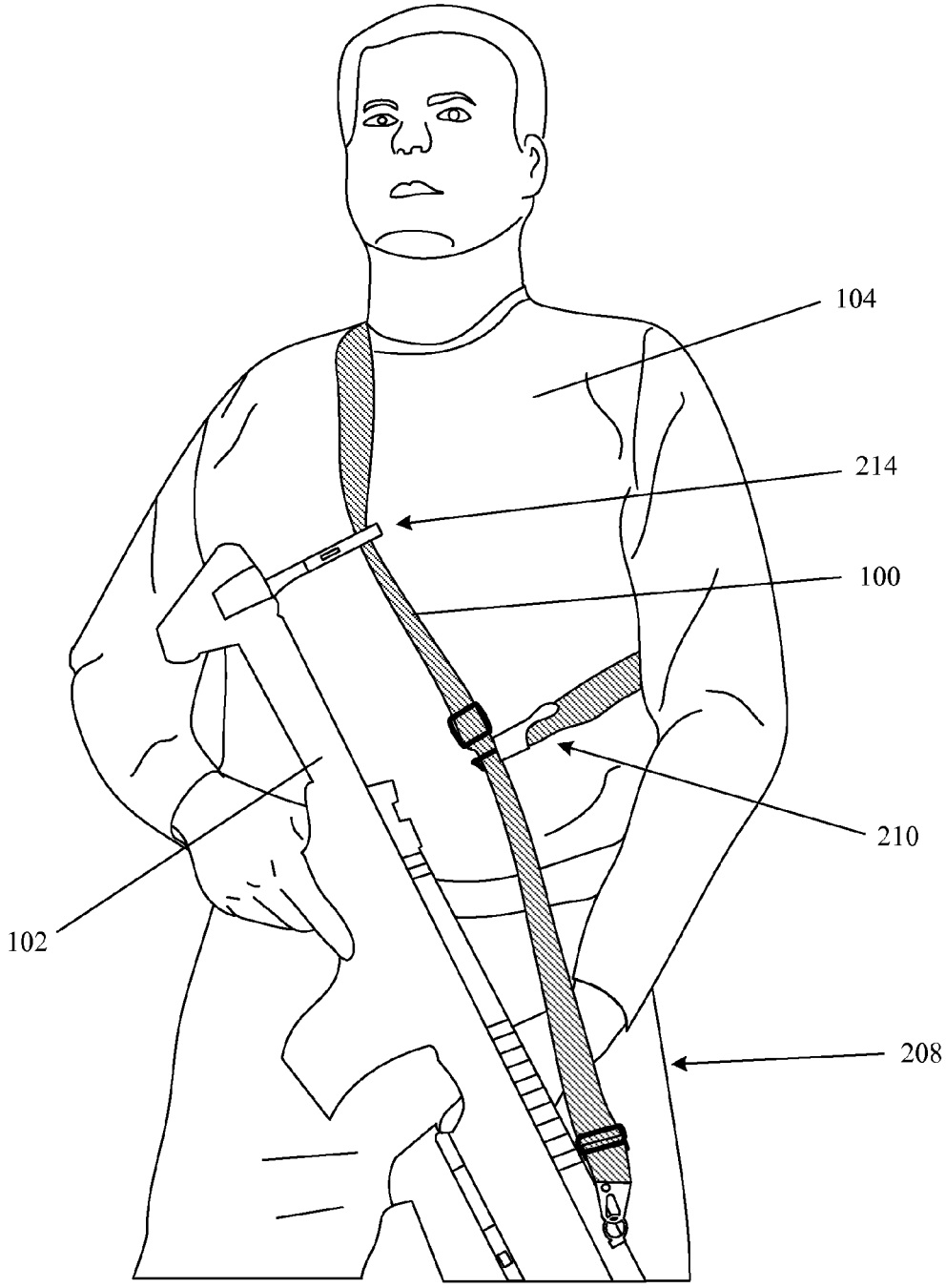
FIG. 5 is a perspective view of a multi-position sling in a three-point mode in accordance with an embodiment of the invention, with the sling shown supporting a firearm from a person.

FIG. 5 is a perspective view of a multi-position sling 100 in a three-point mode for supporting a firearm 102 from a user or person 104. The embodiment shown in FIG. 5 is deployed in a third mode or "three point" mode. As shown in FIG. 5, the firearm 102 is supported from a user or person 104 via the first connector 208, the second connector 210, and fourth connector 214, or at three points, by the sling 200. In this particular mode, the sling can afford excellent control of the firearm as it hangs high, in front of the shooter.

Referring to FIG. 2, to configure and wear a sling in accordance with an embodiment of the invention for this particular mode, the first connector 208 can be mounted to a firearm connector, such as a FASTEX™ side release buckle connector having a corresponding female-end, associated with a front sling point of the firearm. Furthermore, the second connector 210 can be mounted to a firearm connector, such as a FASTEX™ side release buckle connector having a corresponding female-end, associated with an intermediate sling point of the firearm. Further, the fourth connector 214 can be mounted to a firearm connector, such as a FASTEX™ side release buckle connector having a corresponding female-end, associated with a rear sling point of the firearm. Either or both of the first adjustment device 228 and third adjustment device 232 can be positioned relative to respective positions along the strap 202 to increase or decrease the length of the strap 202. When the third adjustment device 232 is repositioned with respect to the strap 202, relatively greater changes in the length of the strap 202 can be achieved. The strap 202 can then be positioned over a portion of a user's body, such as across his or her shoulder or upper torso. The first covering device 238 and second covering device 230 can be adjusted as needed to maintain the positions of respective connectors 210, 214 or to cover particular portions of the strap 202. In this manner, the sling 200 can support a firearm such as 102 from a user or person.

Figure 6:
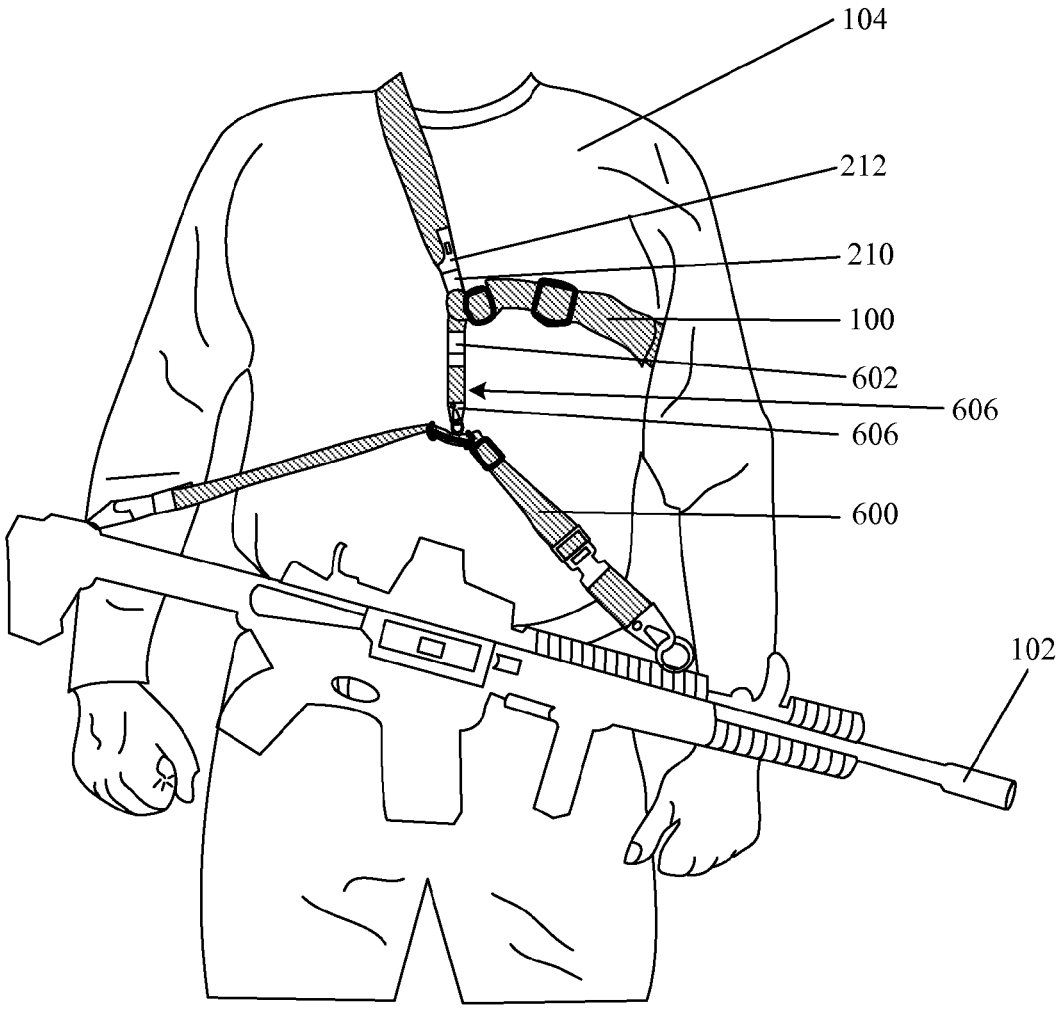
FIG. 6 is a perspective view of a multi-position sling in an extreme mode in accordance with an embodiment of the invention, with the sling shown supporting a firearm from a person.

FIG. 6 is a perspective view of a multi-position sling 100 in an extreme mode for supporting a firearm 102 from a user or person 104. The embodiment shown in FIG. 6 is deployed in a fourth mode or "extreme" mode. As shown in FIG. 6 and also with reference to FIG. 2, the firearm 102 is supported from a user or person 104 via the first connector 208 by the sling 200. A two-point strap 600, such as a two point strap with a Transitioner™ piece 602, can be connected to the firearm 104 adjacent to the rear of the firearm receiver and adjacent to a forward sling attachment point of the firearm. As shown in FIG. 6, the second connector 210 and third connector 212 are mounted together to form a loop. The loop can be positioned over a portion of a user's body, such as a shoulder or upper torso. The first connector 208 can then mount to a corresponding connector 606 associated with the Transitioner™ piece 602. Either or both of the first adjustment device 228 and third adjustment device 232 can be positioned relative to respective positions along the strap 202 to increase or decrease the length of the strap 202. When the third adjustment device 232 is repositioned with respect to the strap 202, relatively greater changes in the length of the strap 202 can be achieved. The strap 202 can then be positioned over a portion of a user's body, such as across his or her shoulder or upper torso. The first covering device 238 and second covering device 230 can be adjusted as needed to maintain the positions of respective connectors 210, 214 or to cover particular portions of the strap 202. In this manner, the sling 200, 600 can support a firearm 102 from a user or person.

This particular mode can provide improved user access to the firearm such as the bolt release, thus permitting relatively quicker user deployment of the firearm. The embodiment shown also offers the user the ability to perform a shoulder transition function for a firearm similar to a single point sling. In this manner, a user can have the ability to immediately swing the firearm to a horizontal mode while assessing a potential target.

Figure 7:
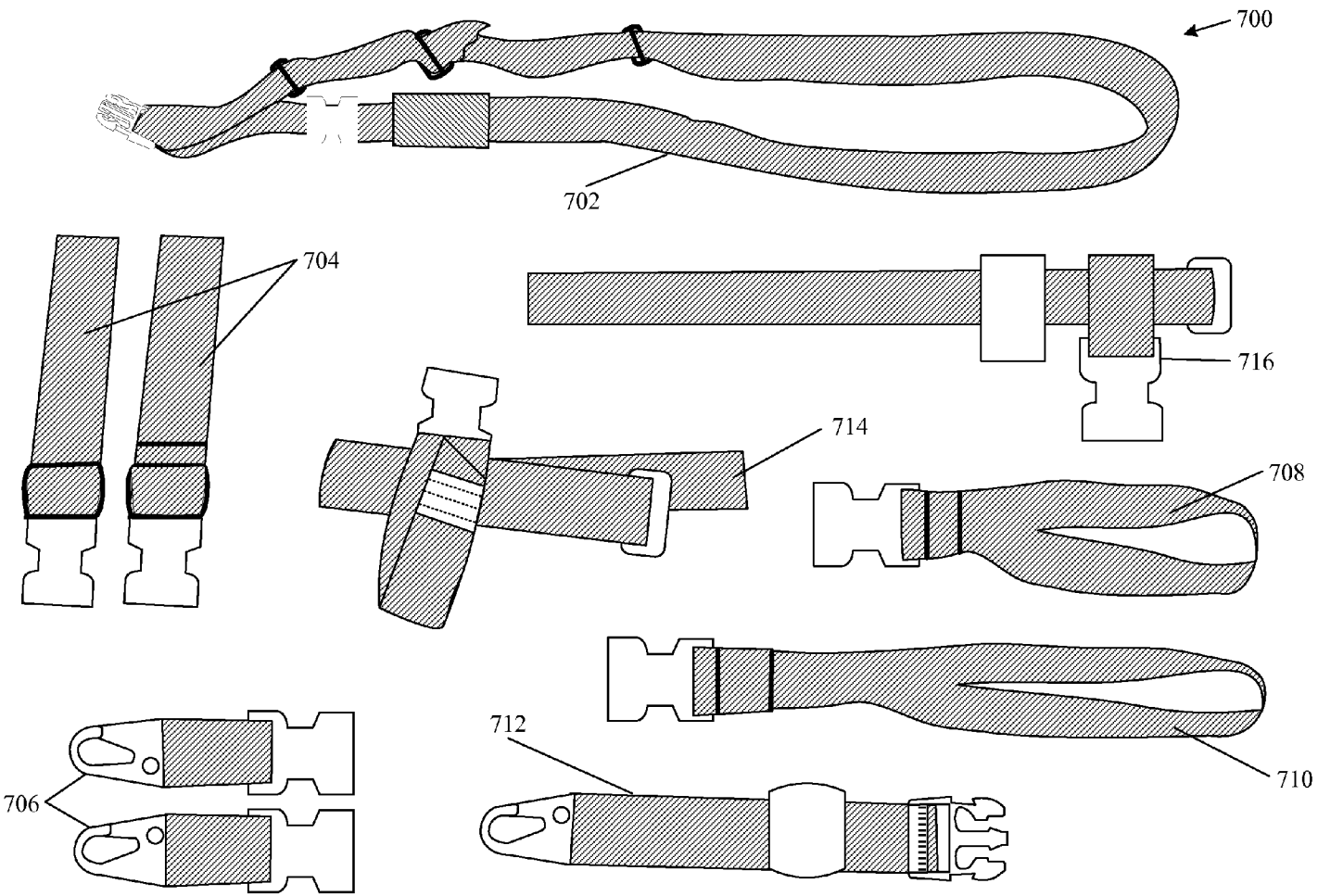
FIG. 7 is an overhead view of a kit including a multi-position sling in accordance with an embodiment of the invention.

FIG. 7 illustrates a kit associated with an embodiment of the invention, and FIGS. 8-14 illustrate various components of the kit shown in FIG. 7. The kit 700 shown in FIG. 7 can include a sling 702, and a variety of other components 704, 706, 708, 710, 712, 714, such as firearm connectors or other types of connectors. The sling 702 shown can be a sling as described in FIGS. 2-6. As shown in FIG. 7, the kit 700 can include a sling 702, one or more adapter straps 704, one or more hook adapters 706, one or more loop adapters 708, 710, one or more vest straps 712, and one or more firearm adapters 714. The various components of the kit are useful to adapt the sling 702 to different types of firearms, associated equipment carried by a user or person and/or situational circumstances associated with using the sling. One example of a kit is manufactured and distributed by Blue Force Gear of Savannah, Ga. under the brand name SOC-C™ Sling Contractor Pak™. A kit in accordance with other embodiments of the invention can include fewer or greater numbers of components.

Figure 8:
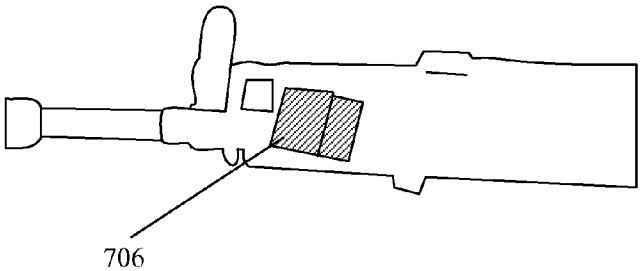

The adapter strap 704 shown in FIGS. 7 and 8 can be used for mounting a firearm connector to a firearm, such as buttstock of a firearm or rifle. The adapter straps 704 can be a FASTEX™ side release buckle connector with a female-end and a relatively short length of strap looped through an end of the buckle. Two rings can be mounted to the strap adjacent to the end of the buckle. One example of an adapter strap is manufactured and distributed by Blue Force Gear of Savannah, Ga. under the part name "SOC-C-CBS," described as a female adapter strap for fixed sling loops. An adapter strap in accordance with other embodiments of the invention can have alternative configurations, and can include fewer or greater numbers of components.

Figure 9:
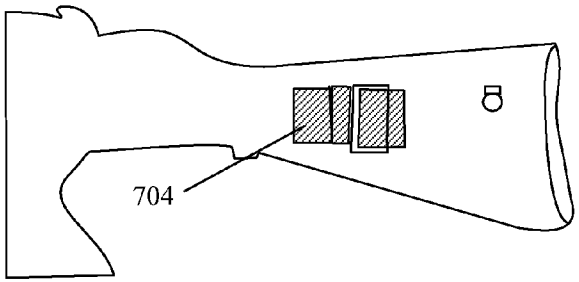
FIGS. 8-14 illustrate various components of the kit shown in FIG. 7.

The hook adapter 706 shown in FIGS. 7 and 9 can be used for mounting a firearm connector to a front portion of a firearm. The hook adapters 706 can be a FASTEX™ side release buckle connector with a female-end and a relatively short length of strap looped through an end of the buckle. An opposing end of the strap can include a manual clip hook. One example of a hook adapter is manufactured and distributed by Blue Force Gear of Savannah, Ga. under the part name "SOC-C-HK," described as a female HK hook adapter. A hook adapter in accordance with other embodiments of the invention can have alternative configurations, and can include fewer or greater numbers of components.

Figure 10:
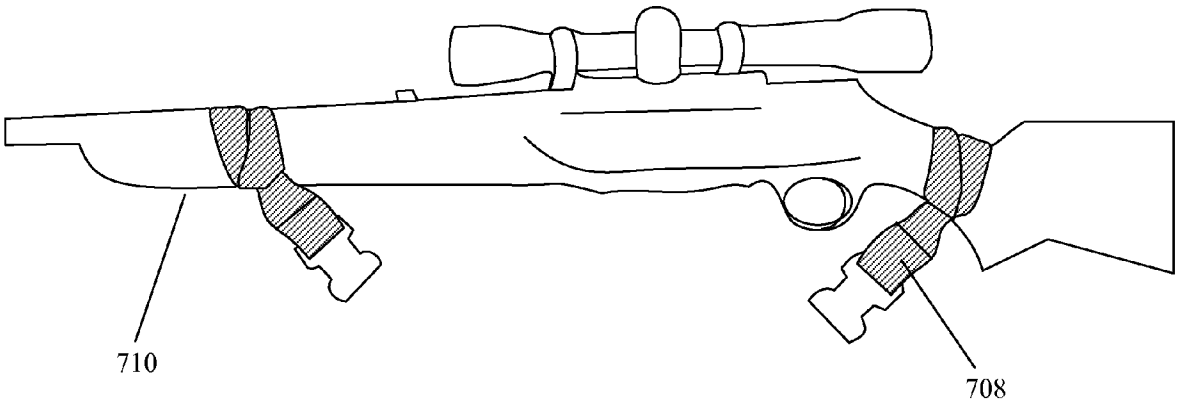

The loop adapters 708, 710 shown in FIGS. 7 and 10 can be used for mounting a firearm connector to a portion of a firearm, such as a portion of the barrel or a portion of a buttstock associated with a firearm. The loop adapters 708, 710 can be a FASTEX™ side release buckle connector with a female-end and a length of strap looped through an end of the buckle and comprising a relatively small loop. Examples of loop adapters are manufactured and distributed by Blue Force Gear of Savannah, Ga. under the part names "SOC-C-CBLM" and "SOC-C-CBLL" described respectively as universal loop adapter, medium and universal loop adapter, large. A loop adapter in accordance with other embodiments of the invention can have alternative configurations, and can include fewer or greater numbers of components.

Figure 11:
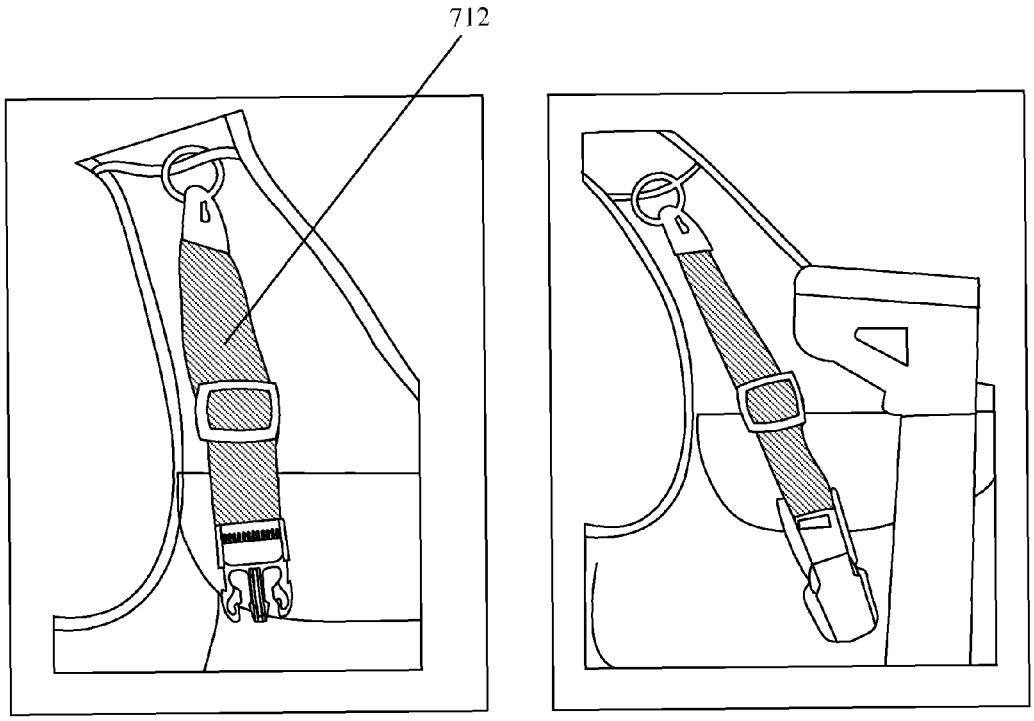

The vest strap 712 shown in FIGS. 7 and 11 can be used for mounting a connector to a vest. The vest straps 712 can be a FASTEX™ side release buckle connector with a male-end and a length of strap looped through an end of the buckle. A tri-glide is mounted to the strap, and an opposing end of the strap includes a manual clip hook. One example of a vest strap is manufactured and distributed by Blue Force Gear of Savannah, Ga. under the part name "SOC-C-CBV" described as a vest/LCE strap. A vest strap in accordance with other embodiments of the invention can have alternative configurations, and can include fewer or greater numbers of components.

Figure 12:
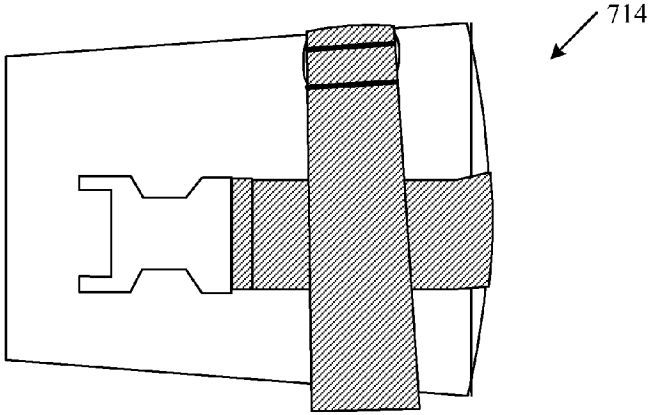

The firearm adapters 714, 716 shown in FIGS. 7 and 12 can be used for mounting a firearm connector to a buttstock of a firearm. One example of a firearm adapter shown as 714 can be a FASTEX™ side release buckle connector with a female-end and a length of strap looped through an end of the buckle. The strap can include other pieces of strap mounted to form a relatively small loop or buttstock-shape as needed. One or more rings can be mounted to the strap as needed. This example of a firearm adapter is manufactured and distributed by Blue Force Gear of Savannah, Ga. under the part name "SOC-C-CBA2" described as an adapter band for M16A1/A2 buttstocks.

Another example of a firearm adapter shown as 716 in FIG. 7 can be a FASTEX™ side release buckle connector with a female-end and a length of strap looped through an end of the buckle. The strap can include other pieces of strap mounted to form a relatively small loop as needed. One or more rings and a fastener such as Velcro™ can be mounted to the strap as needed. This example of a firearm adapter is manufactured and distributed by Blue Force Gear of Savannah, Ga. under the part name "SOC-C-CBFB" described as an adapter band for a particular model of rifle or firearm. A firearm adapter in accordance with other embodiments of the invention can have alternative configurations, and can include fewer or greater numbers of components.

Figure 14:
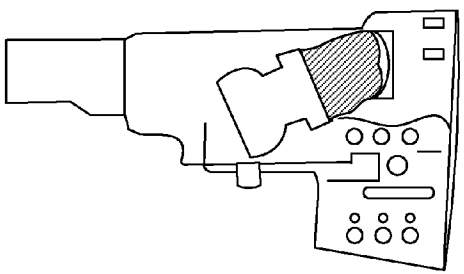
Figure 13:
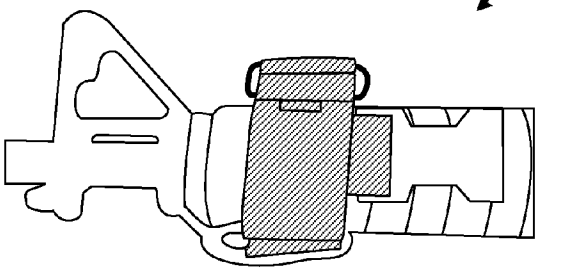

FIGS. 13 and 14 illustrate other pieces of another kit in accordance with another embodiment of the invention. These are examples of firearm adapters in accordance with other embodiments of the invention. FIG. 13 illustrates an example of a firearm adapter 800 with a FASTEX™ side release buckle connector having a female-end and a length of strap looped through an end of the buckle. The strap can include other pieces of strap mounted to form a relatively small loop as needed. One or more rings can be mounted to the strap as needed. One example of a firearm adapter is manufactured and distributed by Blue Force Gear of Savannah, Ga. under the part name "SOC-C-CBFB."

FIG. 14 illustrates an example of a firearm adapter 900 with a FASTEX™ side release buckle connector having a female-end and a length of strap looped through an end of the buckle. The strap can include other pieces of strap mounted to form a relatively small loop as needed. One example of a firearm adapter is manufactured and distributed by Blue Force Gear of Savannah, Ga. under the part name "SOC-C-CLM."

While the above description contains many specifics, these specifics should not be construed as limitations on the scope of the invention, but merely as exemplifications of the disclosed embodiments. Those skilled in the art will envision any other possible variations that are within the scope of the invention.

The invention claimed is:

1. An apparatus for supporting a firearm from a user, wherein the firearm is adapted with at least one firearm connector, the apparatus comprising:

a strap capable of being supported by a portion of a user's body;

a first connector mounted to a first portion of the strap, the first connector mounting to a firearm connector to configure the apparatus to a single point mode, a two point mode, or a three point mode;

a second connector mounted to a second portion of the strap, the second connector mounting to a third connector to configure the apparatus to the single point mode or the three point mode, and mounting to a second firearm connector to configure the apparatus to the two point mode, wherein the second firearm connector mounts to a second portion of the firearm; and the third connector mounted to a third portion of the strap, the third connector mounting to the second connector to configure the apparatus to the single point mode, wherein the mounting of the second connector to the third connector when configuring the apparatus to the single point mode or the three point mode creates a loop in the strap;

wherein the mounting of the second connector to the second firearm connector when configuring the apparatus to the two point mode creates space for the user's body between the firearm and the strap;

a fourth connector mounted to a fourth portion of the strap, wherein the fourth connector mounts to the second firearm connector to configure the apparatus to the three point mode;

wherein the firearm can be aimed and discharged when supported in the single point mode, two point mode, and three point mode.

2. The apparatus of claim 1, wherein the apparatus further comprises:

an adjustment device capable of sizing the loop.

3. The apparatus of claim 1, wherein the apparatus further comprises:

a covering device positioned along the strap, wherein the covering device limits movement of at least one of the following: first connector, second connector, or third connector.

4. The apparatus of claim 1, wherein the apparatus further comprises:

an adjustment device capable of sizing the loop.

5. The apparatus of claim 1, wherein the apparatus further comprises:

a covering device positioned along the strap, wherein the covering device limits movement of at least one of the following: first connector, second connector, third connector, or fourth connector.

6. The apparatus of claim 1, wherein the firearm comprises at least one of the following: a rifle, an automatic weapon, a semi-automatic weapon, a manually fired weapon, a M4, a M16A1, or a M16A2.

7. The apparatus of claim 1, wherein the strap comprises at least one of the following: a non-infrared material, or a near-infrared material.

8. The apparatus of claim 1, wherein each of the connectors comprise at least one of the following: a side release buckle connector with a male-end, a side release buckle connector with a female-end, a side release buckle, a cam buckle, a snap hook, or a push button quick disconnect (QD)-type device, an eyelet, a quick-release snap shackle, a swivel stud.

9. The apparatus of claim 2, wherein the adjustment device comprises at least one of the following: a triglide, a ladderloc, or a cam lock.

10. The apparatus of claim 3, wherein the covering device comprises at least one of the following: a band, or an elastic band.

11. The apparatus of claim 4, wherein the adjustment device comprises at least one of the following: a triglide, a ladderloc, or a cam buckle.

12. The apparatus of claim 5, wherein the covering device comprises at least one of the following: a band, or an elastic band.

13. The apparatus of claim 10, wherein the portion of the firearm comprises at least one of the following: receiver, front portion of a firearm, a handguard, rear portion of a firearm, buttstock, or a barrel of a firearm.

14. A system for supporting a firearm from a user in at least one of multiple point modes, the system comprising:

at least one firearm connector capable of mounting to a portion of a firearm; and a sling capable of supporting a firearm from a portion of a user's body, and further capable of being configured to a single point mode, two point mode, or three point mode, the sling comprising:

a strap capable of being supported by a portion of a user's body;

a first connector mounted to a first portion of the strap, the first connector mounting to a first firearm connector to configure the sling to a single point mode, a two point mode, or a three point mode;

a second connector mounted to a second portion of the strap, the second connector mounting to a third connector to configure the sling to the single point mode or the three point mode, and mounting to a second firearm connector to configure the sling to the two point mode, wherein the second firearm connector mounts to a second portion of the firearm; and the third connector mounted to a third portion of the strap, the third connector mounting to the second connector to configure the sling to the single point mode or the three point mode, wherein the mounting of the second connector to the third connector when configuring the sling to the single point mode or the three point mode creates a loop in the strap;

wherein the mounting of the second connector to the second firearm connector when configuring the sling to the two point mode creates space for the user's body between the firearm and the strap;

a fourth connector mounted to a fourth portion of the strap, wherein the fourth connector mounts to the second firearm connector to configure the sling to the three point mode;

wherein the firearm can be aimed and discharged when supported in the single point mode, two point mode, and three point mode.

15. The system of claim 14, wherein the sling further comprises:

an adjustment device capable of sizing the loop.

16. The system of claim 14, wherein the sling further comprises:

a covering device positioned along the strap, wherein the covering device limits movement of at least one of the following: first connector, second connector, or third connector.

17. The system of claim 14, wherein the sling further comprises:

an adjustment device capable of sizing the loop.

18. The system of claim 14, wherein the sling further comprises:

a covering device positioned along the strap, wherein the covering device limits movement of at least one of the following: first connector, second connector, third connector, or fourth connector.

19. The system of claim 14, wherein the firearm comprises at least one of the following: an automatic weapon, a semi-automatic weapon, a manually fired weapon, a M4, a M16A1, or a M16A2.

20. The system of claim 14, wherein the strap comprises at least one of the following: a non-infrared material, or a near-infrared material.

21. The system of claim 14, wherein the connectors comprise at least one of the following: a side release buckle connector with a male-end, a side release buckle connector with a female-end, a side release buckle, a cam buckle, a snap hook, a push button quick disconnect (QD)-type device, an eyelet, a quick-release snap shackle, or a swivel stud.

22. The system of claim 15, wherein the adjustment device comprises at least one of the following: a triglide, a ladderloc, or a cam buckle.

23. The system of claim 16, wherein the covering device comprises at least one of the following: a band, or an elastic band.

24. The system of claim 17, wherein the adjustment device comprises at least one of the following: a triglide, ladderloc, or a cam buckle.

25. The system of claim 18, wherein the covering device comprises at least one of the following: a band, or an elastic band.

26. The system of claim 14, wherein the portion of the firearm comprises at least one of the following: receiver, front portion of a firearm, a handguard, rear portion of a firearm, buttstock, or a barrel.

* * * * *